United States Patent [19]

Im et al.

[11] 3,953,200

[45] Apr. 27, 1976

[54] NICKEL EXTRACTION PROCESS

[75] Inventors: Suk Joong Im, Southfield, Mich.; James D. Johnston, Baton Rouge, La.

[73] Assignee: Ethyl Corporation, Richmond, Va.

[22] Filed: Mar. 27, 1975

[21] Appl. No.: 562,420

[52] U.S. Cl. ..... 75/103; 75/101 R; 75/119; 423/150

[51] Int. Cl.[2] ..... C22B 23/04

[58] Field of Search ..... 75/103, 119, 101 R; 423/150

[56] References Cited

UNITED STATES PATENTS

| | | | |
|---|---|---|---|
| 709,277 | 9/1902 | Perron | 423/150 |
| 1,071,791 | 9/1913 | Pugsley | 423/150 X |
| 1,103,346 | 7/1914 | Butters | 75/118 |
| 1,352,832 | 9/1920 | Priest | 75/118 X |
| 2,368,194 | 1/1945 | Brenner | 423/150 X |
| 3,860,689 | 1/1975 | Seffon et al. | 75/119 X |

*Primary Examiner*—G. Ozaki

*Attorney, Agent, or Firm*—Donald L. Johnson; Robert A. Linn

[57] ABSTRACT

A process for extracting nickel from a low-grade nickel complex ore. The process features simultaneously grinding and leaching of the ore with an aqueous ammoniacal leach solution.

10 Claims, No Drawings

NICKEL EXTRACTION PROCESS

BACKGROUND OF THE INVENTION

The subject matter of the present invention is the recovery of nickel values from a low-grade complex nickel ore. The extraction process comprises a simultaneous grind-leach of the ore.

Commercially significant nickel deposits are of two main types: (i) sulphides which are primary nickel ores or rock materials and (ii) laterites and garnierites which are secondary nickel ores or rock materials. The nickel bearing laterites and garnierites result from the deterioration of primary rock materials through weathering, erosion and related chemical and physical processes during which the nickel values are greatly concentrated compared with the primary rock materials and are deposited in layers of altered residual rock materials. These nickel bearing laterites and garnierites normally contain from about 1.5 to about 3 percent nickel.

Primary rock materials with a low nickel content, typically below 0.5 percent, are found in various Precambrian and Cordillera regions in Alaska, Asia, Australia, Canada, Northern Europe and in various tropical and subtropical regions. In Canada the low-grade primary nickel ores are characteristically found in the form of peridotite or other ultramafic rock formations. These formations represent huge reserves of nickel. However, due to the small amounts of nickel present it is difficult to extract nickel from these ores with any degree of commercial feasibility. Several techniques have been used in attempting to extract the nickel on a commercially feasible basis. These methods include various flotation, magnetic separation and roast-leach processes. However, these techniques have not proved to be entirely satisfactory, either because of rather low nickel recoveries or because of rather high costs.

We have discovered a novel process for extracting nickel from nickel bearing sulfide ores of the above type. This process gives high nickel recoveries and offers promise of low cost. The process utilizes simultaneous grinding and leaching of these ores with an aqueous ammoniacal solution.

SUMMARY OF THE INVENTION

A process for recovering nickel from a low-grade nickel complex ore by simultaneously comminuting the ore and leaching with an aqueous ammoniacal leach solution.

DESCRIPTION OF THE PREFERRED EMBODIMENTS

An embodiment of the present invention is a process for recovering an increased quantity of nickel values from a low-grade nickel complex ore which comprises simultaneously grinding and leaching with an ammonia and ammonium salt solution a comminuted low-grade nickel ore characterized by having a nickel content of not more than about 0.5 percent by weight and a sulfur: nickel ratio of one or less than one for a time sufficient to form a resultant aqueous solution of nickel values, and then separating the leachant solution from any insoluble material which remains after said leaching-comminuting process whereby a resultant aqueous solution containing an increased quantity of nickel values is obtained.

In a preferred embodiment of the present invention the process comprises simultaneously grinding and leaching with an ammonia and ammonium salt solution, additionally containing an amount of sulfite and carbonate ions sufficient to enhance nickel leaching, of a comminuted low-grade nickel ore characterized by having a nickel content of not more than about 0.5 percent by weight and a sulfur: nickel ratio of one or less than one for a time sufficient to form a resultant aqueous solution of nickel values.

The native low-grade complex nickel ores vary some both in physical characteristics and chemical composition depending on the region from which the ores are obtained. These ores typically contain nickel as sulphides, oxides, silicates, alloys, and to a minor degree, arsenides. The nickel sulphide minerals are primarily millerite and pentlandite, but also may include siegenite, violarite, heazlewoodite, polydymite and gersdorfite. These ores may also contain iron-nickel alloys such as awaurite. Other minerals found in such peridotite ores are serpentine, talc, magnetite, dolomite, brucite, and chromite. The nickel content of such peridotite ores generally falls below 0.5 percent.

These peridotite ores also have very low sulphur, low iron (1% to 10%) and low copper contents. These ores are further characterized by having a low sulphur to nickel weight ratio, generally of one or less than one. The results of an analysis of a sample of peridotite ore from Canada are set forth in Table I.

Table I

| | | |
|---|---|---|
| % Nickel | Ni | 0.38 |
| % Sulphur | S | 0.09 |
| % Silica | $SiO_2$ | 34.64 |
| % Iron | Fe | 5.30 |
| % Alumina | $Al_2O_3$ | 0.51 |
| % Lime | CaO | 0.03 |
| % Magnesia | MgO | 40.86 |

In contrast to these low-grade peridotite ores which generally have a nickel content of from about 0.2% to about 0.4% the nickel-bearing laterites, which are normally the ores of commercial exploitation, contain from 1.5% to 3% nickel.

In accordance with the present invention the low-grade nickel ore is first pulverized in a conventional crusher to small particles, as for example particles of about 14 mesh. These small particles are then further ground, such as in a ball mill, to particles of a relatively fine size, such as for example particles of about 200 mesh. During this grinding of the particles from small particle size to fine particle size the leaching agent is introduced and the particles are subjected to leaching while being ground. A suitable leaching agent is an aqueous ammoniacal leach solution. This solution, which can be a typical leach solution known in the art, contains $NH_3$ and an ammonium salt. The ammonia may be introduced as a water-containing ammonium salt, an aqueous ammonium hydroxide, an aqueous solution of dissolved ammonia gas and water, or ammonia gas. In a preferred embodiment the aqueous ammoniacal leach solution can preferably additionally contain sulfite or carbonate ions. Thus, a preferred aqueous ammoniacal leach solution will contain ammonia and sulfite, or ammonia and carbonate.

The amounts of sulfite or carbonate in the leach solutions defined above can be provided by introducing $SO_2$ or $CO_2$ gas, respectively, into the aqueous ammoniacal solution. Alternatively, and preferably, the equivalent amounts of sulfite and carbonate are introduced into the solution as soluble salts, e.g., of ammonia or sodium. Preferably, the sulfite is introduced as ammonium sulfite, while the carbonate is introduced into the solution as ammonium carbonate. Mixtures of gas and salt can also be used, as for example a mixture of $CO_2$ and ammonium carbonate or $SO_2$ and ammonium sulfite.

When sulfite is present in the leach solution, it is preferred that the concentration be at least about 5 grams of sulfite per liter of solution. A preferred concentration of sulfite is at least about 25 grams per liter. A more preferred concentration of sulfite is at least about 50 grams per liter with a most preferred concentration being at least about 75 grams per liter. There is no real upper limit on the concentration of the sulfite. Instead, the upper limit is determined by such secondary considerations as solubility of the sulfite in the leach solution, economics and convenience.

When carbonate is present in the leach solution, it is preferred that the concentration be at least about 5 grams of carbonate per liter of solution. A preferred concentration of carbonate is at least about 25 grams of carbonate per liter of solution. A more preferred concentration is at least about 50 grams per liter with a most preferred concentration being at least about 75 grams per liter. There is no real upper limit on the carbonate concentration and the upper limit is, therefore, determined by such secondary considerations as solubility of carbonate in the solution, economics and convenience.

The aqueous ammoniacal leach solution is a conventional ammonia-ammonium solution which contains ammonia and an ammonium salt. Typical ammonium salts useful in the practice of the present invention are the chloride, carbonate, sulfate, phosphate, bromide, iodide, phosphite, sulfite, cyanide, fluoride, sulfide, and the like, including mixtures thereof.

The resultant slurry obtained by introducing the ore into the aqueous ammoniacal leach solution preferably contains from about 5% to about 65% solid loading, that is the resultant slurry contains from about 5% by weight solids and about 95% by weight liquor to about 65% solids and about 35% liquor. More preferably the slurry contains from about 7% to about 60% solid loading. Most preferably the resultant solution contains from about 10% to about 50% solid loading.

The process of the present invention is conducted at or about room or ambient temperatures and at or about atmospheric pressures. If $CO_2$ or $SO_2$ gas is used, however, it may be desirable to carry out said process in a closed system. The process can be carried out at elevated temperatures and superatmospheric or subatmospheric pressures. Generally, there is no real advantage from conducting the process under vacuum. There is no real upper limit on the temperatures and pressures at which this process can be carried out and accordingly the temperatures and pressures are not critical and are selected with such secondary considerations as design of the reaction vessels, solution boiling and freezing points, economics, etc. in mind.

GENERAL PROCEDURE

Twenty grams of low-grade nickel ore, pulverized to about 14 mesh, are charged to a ball mill. One hundred milliliters of ammonia/ammonium salt leach solution are also charged to said ball mill. Grinding is then begun and carried on at room temperatures and atmospheric pressure for a period of about 24 hours. At the end of the 24-hour period the ore has been ground to about 200 mesh. The leach mixture, which consists of the ground ore and the leaching solution containing soluble nickel, is filtered and the filtrate is analyzed for soluble nickel metal content.

Following is a tabulation of data obtained from a series of five samples of ore processed in accordance with the aforedescribed procedure.

Table II

| Ex. | Leaching Agent (g/l) | Leaching Time (hours) | % Ni Extracted |
|---|---|---|---|
| 1 | 90 $NH_3$ | 3 | 27.0 |
| | 75 $SO_2$* | 6 | 44.0 |
| | | 12 | 62.0 |
| | | 24 | 68.5 |
| 2 | 100 $NH_3$ | 3 | 50.5 |
| | 50 $CO_2$** | 6 | 63.2 |
| | | 12 | 70.1 |
| | | 24 | 76.0 |
| 3 | 100 $NH_3$ | 1 | 28.0 |
| | 50 $CO_2$ | 3 | 65.3 |
| | | 6 | 70.7 |
| | | 12 | 74.0 |
| | | 24 | 79.1 |
| 4 | 75 $NH_3$ | 3 | 47.0 |
| | 37.5 $CO_2$ | 6 | 63.0 |
| | | 12 | 77.0 |
| | | 24 | 78.0 |
| 5 | 50 $NH_3$ | 3 | 35.0 |
| | 25 $CO_2$ | 6 | 53.0 |
| | | 12 | 71.5 |
| | | 24 | 74.5 |

*Actual species in solution are $SO_3^{=}$ and $SO_4^{=}$
**Actual species in solution is $CO_3^{=}$ In Example 1 enough aqueous $NH_3$ was added to the leach solution to give an equivalent ammonia concentration of 90 grams/liter, and enough $(NH_4)_2SO_3$ was added to provide an equivalent $SO_2$ concentration of 75 grams/liter. In Example 2 enough aqueous $NH_3$ was added to the leach solution to give an equivalent ammonia concentration of 100 grams/liter, and enough $(NH_4)_2CO_3$ was added to give an equivalent $CO_2$ concentration of 50 grams/liter. In Example 3 enough ammonia was added, in an aqueous solution of $NH_3$ and $H_2O$, to give an equivalent ammonia concentration of 100 grams/liter of ammonia, and enough $CO_2$ gas was passed into the leach solution to give an equivalent $CO_2$ concentration of 50 grams/liter. In Example 4 enough ammonia, in its gaseous state, was added to the leach solution to give an equivalent ammonia concentration of 75 grams/liter, and enough $CO_2$ gas was introduced into the leach solution to give an equivalent $CO_2$ concentration of 37.5 grams/liter. In Example 5 enough $NH_3$, in its gaseous state, was added to give an equivalent ammonia concentration of 50 grams/liter and enough $(NH_4)_2CO_3$ was added to give an equivalent $CO_2$ concentration of 25 grams/liter.

In Example 3 the ore, after being pulverized to a particle size of from about 35 mesh to about 14 mesh but previous to the simultaneous grinding and leaching, was additionally treated by passing $SO_2$ gas through said ore and heating said crushed ore for about one hour at about 200°C. This pretreated ore was then simultaneously ground to a particle size of about 200 mesh and leached with the ammoniacal leach solution. As can be seen from the data tabulated in Table II the percent of nickel extracted into the leach solution was much higher during the early stages of the grinding-leaching step than in the untreated ore samples. However, the amount of nickel present in the leach solution after 24 hours of grinding-leaching was about the same as in the untreated samples.

To show the unexpected and superior results of the simultaneous grind-leach process of the present invention as compared to the usual grinding and then leaching process a sample of ore was processed according to a method wherein the ore was first ground and then leached. In this method twenty grams of a low-grade nickel ore of about 14 mesh was first ground in a ball mill for a period of about 24 hours. At the end of this 24-hour period grinding was halted and the particles were found to be of a size of about 200 mesh. To these 200 mesh particles was added one hundred milliliters of an ammonia/ammonium salt leach solution. Leaching was carried out while agitating the mixture at room temperature and atmospheric temperature for 24 hours. At the end of this 24-hour period the leached mixture is filtered and the filtrate is analyzed for soluble nickel metal content.

Following is a tabulation of data for this example.

TABLE III

| Ex. | Leaching Agent (g/l) | Leaching Time (hours) | % Ni Extracted |
|---|---|---|---|
| 6 | 90 $NH_3$ | 3 | 10.0 |
| | 75 $SO_2$ | 6 | 14.0 |
| | | 12 | 20.0 |
| | | 24 | 25.2 |

From the data in Tables II and III, it is clear that the simultaneous grinding and leaching, with $NH_3/NH_4^+$ solution, results in an unexpectedly and substantially increased amount of nickel extracted as compared to separate grinding and leaching. Furthermore, while the ores in Examples 1–5 were processed, i.e., ground and leached, in 24 hours, since grinding and leaching are carried on concurrently, the processing of the ore in Example 6 took twice as long — 24 hours to first grind the ore and then an additional 24 hours to leach the ground ore. Thus, not only does the process of the present invention result in at least a 100% increase in nickel extraction over the previous consecutive grinding and leaching process, but accomplishes this increase in half the time that it is necessary to carry out the consecutive grinding and leaching process.

The amount of recoverable nickel values solubilized into the leach solution is also dependent upon the concentration of $NH_3$, $CO_2$ or $SO_2$ in the leach solution. Thus, for example, increasing the concentration of $NH_3$ in the leach solution increases the solubilization of nickel into the leach solution at a given temperature. Likewise, increasing the concentrations of $CO_2$ or $SO_2$ in the leach solution results in an increase of recoverable nickel values in the leach solution at a given temperature.

Claims to the invention follow.

We claim:

1. A process for recovering an increased quantity of nickel values from a low-grade complex nickel ore said process comprising simultaneously grinding and leaching with an aqueous ammonia and ammonium salt solution of a comminuted low-grade nickel ore characterized by having a nickel content of not more than about 0.5 percent by weight and a sulfur to nickel ratio of one or less for a time sufficient to form a resultant aqueous solution of nickel values.

2. The process of claim 1 wherein said ore is preground to a size of from about 35 to about 14 mesh before being simultaneously ground and leached.

3. The process of claim 2 wherein said ore is ground, during simultaneous grinding and leaching, from about 35 to about 14 mesh to about 200 mesh.

4. The process of claim 1 wherein said aqueous ammoniacal leach solution contains ammonia and ammonium salt.

5. The process of claim 4 wherein said leach solution additionally contains sulfite ions.

6. The process of claim 5 wherein said leach solution contains at least about 5 grams/liter of sulfite.

7. The process of claim 4 wherein said leach solution additionally contains carbonate ions.

8. The process of claim 7 wherein said leach solution contains at least about 5 grams/liter of carbonate.

9. The process of claim 4 wherein said leach solution additionally contains a halide ion.

10. The process of claim 4 wherein said ammonium salt is selected from ammonium carbonate, ammonium sulfite, ammonium sulfate or ammonium halide.

* * * * *